US009666927B1

(12) United States Patent
Massman

(10) Patent No.: US 9,666,927 B1
(45) Date of Patent: May 30, 2017

(54) COMPACT FOLDED Y-JUNCTION WAVEGUIDE

(71) Applicant: Jeffrey P. Massman, Niceville, FL (US)

(72) Inventor: Jeffrey P. Massman, Niceville, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 417 days.

(21) Appl. No.: 14/246,163

(22) Filed: Apr. 7, 2014

(51) Int. Cl.
*H01P 5/12* (2006.01)
*H01P 3/12* (2006.01)
*H01P 5/19* (2006.01)

(52) U.S. Cl.
CPC . *H01P 3/12* (2013.01); *H01P 5/19* (2013.01)

(58) Field of Classification Search
CPC ..... H01P 3/12; H01P 5/19
USPC ..... 333/125
See application file for complete search history.

(56) References Cited

U.S. PATENT DOCUMENTS

| | | | | |
|---|---|---|---|---|
| 2,848,689 | A * | 8/1958 | Zaleski | H01P 5/12 333/125 |
| 6,411,174 | B1 | 6/2002 | Crouch et al. | |
| 6,621,468 | B2 | 9/2003 | Kanamaluru | |
| 2013/0141168 | A1 | 6/2013 | Nozaki et al. | |
| 2013/0154764 | A1 | 6/2013 | Runyon | |

* cited by examiner

*Primary Examiner* — Robert Pascal
*Assistant Examiner* — Kimberly Glenn
(74) *Attorney, Agent, or Firm* — AFMCLO/JAZ; Jason Sopko

(57) ABSTRACT

A high bandwidth, low signal error, compact waveguide includes a conductive body including a waveguide input portion and a plurality of waveguide output portions disposed coplanar with the input waveguide portion. The waveguide further includes a common junction joining the input waveguide portion and the plurality of output waveguide portions. A septum is disposed proximate the common junction collinear with a centerline of the input waveguide portion. The waveguide further includes a plurality of iris elements disposed proximate the common junction transverse to the centerline of the input waveguide portion. The septum and the plurality of iris elements changes an impedance of the common junction to match the impedance across the entire waveguide bandwidth.

11 Claims, 6 Drawing Sheets

COMPACT FOLDED Y-JUNCTION WAVEGUIDE

RIGHTS OF THE GOVERNMENT

The invention described herein may be manufactured and used by or for the Government of the United States for all governmental purposes without the payment of any royalty.

FIELD OF THE INVENTION

The present disclosure relates generally to RF power distribution apparatus, and specifically to combiners or dividers in radio frequency (RF) systems for radar and communication applications.

BACKGROUND OF THE INVENTION

Radio frequency (RF) and microwave circuits and systems typically require power distribution networks to divide an RF input signal at a single input into N quantity RF output signals at N outputs, where N may be defined as any regular number of powers two (N=2, 4, 8, 16, 32, . . . ). Likewise, the power distribution networks can also be used to combine N quantity RF input signals at N inputs into a single RF output signal at a single output. For antenna arrays, the RF power distribution network size is constrained by the antenna feed and power handling requirements.

RF rectangular waveguide technology can be used to implement the power distribution networks due to inherent advantages in power handling capacity and signal integrity. RF rectangular waveguides have the benefit of very low power loss at high frequencies. Unfortunately, the existing art of RF waveguide power distribution devices have very limited frequency bandwidth, generate unacceptable amplitude and phase errors, and can be too large for many aerospace applications.

Therefore, a need exits for a new waveguide RF power distribution technology that can provide wide RF bandwidth operation with low amplitude errors and phase errors in a compact structure for a two way and a four way power combiner/divider.

SUMMARY OF THE INVENTION

The present invention overcomes the foregoing problems and other shortcomings, drawbacks, and challenges of accommodating relatively high operational bandwidths, with low signal error, in a compact waveguide footprint. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a high bandwidth, low signal error, compact waveguide is provided. The waveguide includes a conductive body including a waveguide input portion and a plurality of waveguide output portions disposed coplanar with the input waveguide portion. The waveguide further includes a common junction joining the input waveguide portion and the plurality of output waveguide portions. A septum is disposed proximate the common junction collinear with a centerline of the input waveguide portion. The waveguide further includes a plurality of iris elements disposed proximate the common junction transverse to the centerline of the input waveguide portion. The septum and the plurality of iris elements changes an impedance of the common junction to match the impedance across the entire waveguide bandwidth.

Additional objects, advantages, and novel features of the invention will be set forth in part in the description which follows, and in part will become apparent to those skilled in the art upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

As a preliminary matter, embodiments of the disclosed invention may operate in either a power combining or dividing mode of a waveguide distribution network. Thus, in one exemplary embodiment, the distribution network, or waveguide combiner/divider, is considered to be a passive reciprocal structure. A reciprocal network may be defined as one in which the power losses are the same between any two ports regardless of the direction of propagation. Therefore, for sake of clarity in discussing the embodiments that follow, the examples disclosed herein are generally discussed from a power divider perspective. Stated another way, examples discussed herein are generally with reference to a single signal that is distributed as described herein from an input port (or waveguide portions) a to two or more outputs (N≥2) (waveguide portions). Nevertheless, the use of such language to identify the components of the device is not intended to limit the scope of the description of the invention to only a power divider type device. It will be understood by one of ordinary skill in the art that the same distribution network may be used in a power combiner context, with element nomenclature reconfigured to fit the respective use.

Figure 1:
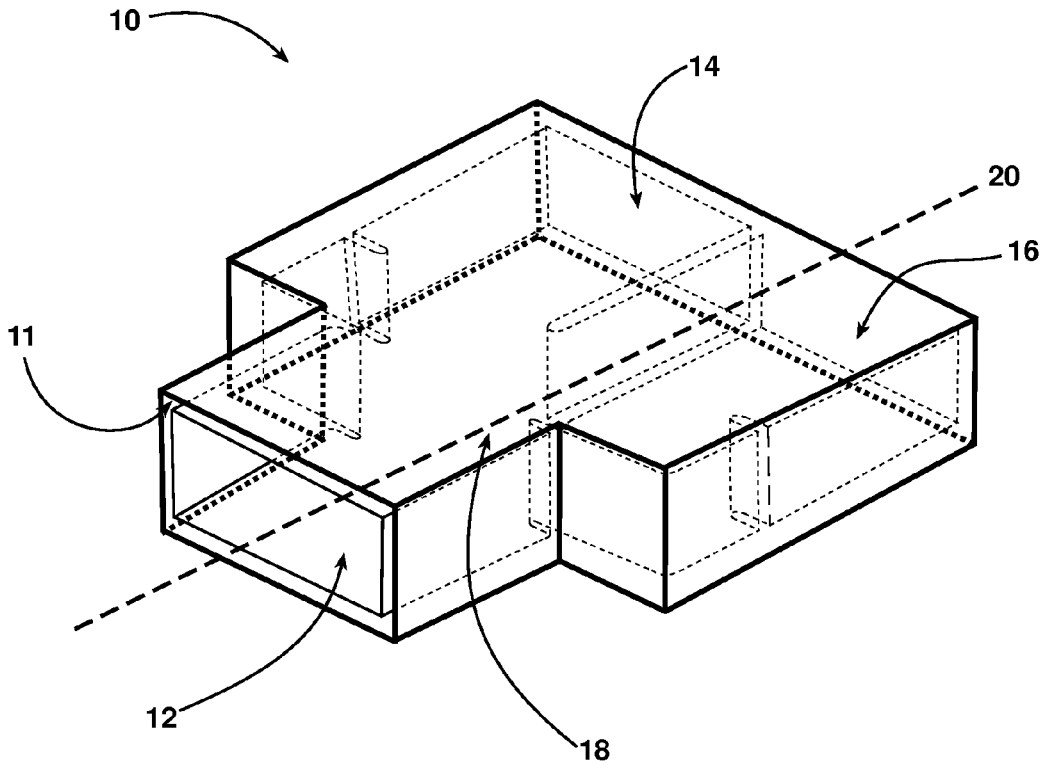
FIG. 1 is a perspective illustration of a folded Y-junction two way power combiner/divider in accordance with an embodiment of the disclosed invention.

With reference to FIG. 1, in an example embodiment, a compact in-line two way (N=2) power combiner/divider is realized in a waveguide structure. The waveguide 10 comprises a single waveguide input 12 and a first and second waveguide output, 14 and 16, respectively. The waveguide input 12 and a first and second waveguide output, 14 and 16, may be referred to as "waveguide portions" of the larger waveguide 10. Additionally, the outer shell of the waveguide 10 may described as having a conductive body 11. The waveguide input 12 and two waveguide outputs 14 and 16 are connected via a common junction 18. The two waveguide outputs 14 and 16 are on opposite sides of the common junction 18 and parallel with the centerline 20 of the waveguide 10. The resulting layout and geometry, as illustrated in this embodiment, is a folded Y-junction power divider; where a single signal incident into waveguide input 12 is split equally into two signals at two waveguide outputs 14 and 16.

In the example embodiment, the waveguide input 12 and waveguide outputs 14 and 16 (as well as other inputs and outputs as will be described in additional embodiments) can be sized for dominant mode signal transmission where the width and height of the waveguide can have a dimension (width "a" and height "b") where "a" is greater than λL/2 and less than λH, where λL is the free-space wavelength at the lowest operational frequency and λH is the free-space wavelength at the highest operational frequency. Waveguide height "b" can be selected to be less than "a" to avoid a degenerate or higher order mode of signal transmission. For example, the lower frequency limit can establish a lower limit to the waveguide size as it is the "waveguide cutoff" where signal transmission effectively ceases. Conventional or standard rectangular waveguide interior has a 2:1 aspect ratio for most cases; though exceptions exist for particular sets of operational frequency bands such as WR-90 waveguide (WR is defined as waveguide rectangular and 90 designates the waveguide standard size).

In the illustrated embodiments of FIG. 1, and in additional embodiments that follow, the waveguide 10 is implemented in WR-90 waveguide, though other embodiments may be optimized for additional applications. The waveguide 10 may be constructed by machining the waveguide channels and impedance matching features in a block of aluminum. Aluminum offers high conductivity and overall good performance to weight metrics. Aluminum can be a good substrate for high speed machining and can also be dimensionally stable. It is possible to use any highly conductive material, such as copper, brass, and silver, to construct the device. For example, the waveguide device can be formed in a copper substrate. Copper can offers high performance and, in the case of manufacturing by electroforming, can offer high performance and precision at the expense of higher cost and manufacturing time.

Figure 2:
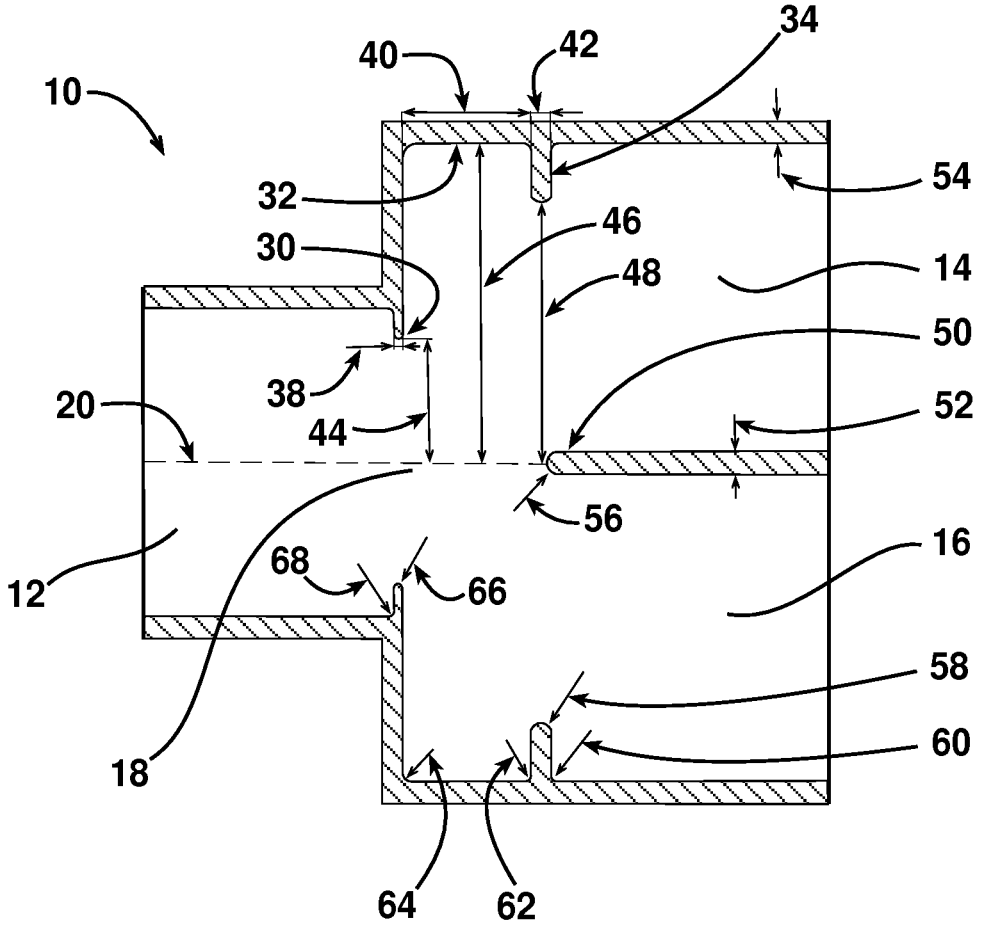
FIG. 2 is a top cutaway illustration of a folded Y-junction two way power combiner/divider in accordance with an embodiment of the disclosed invention.

With reference to FIG. 2 shunt inductive irises consisting of a first element 30, second element 32, and third element 34, are placed symmetrically about the centerline 20. The first element 30, second element 32, and third element 34 have corresponding first distance 38 and first width 44, second distance 40 and second width 46, and third distance 42 and third width 48, respectively. The first element 30, second element 32, and third element 34 result in a shunt inductive reactance placed across the common junction 18.

In this exemplary embodiment, the waveguide 10 is divided at the common junction 18 by an inductive H-plane septum 50 that serves to partially match the impedance of the common junction 18 to that of the waveguide input 12 and waveguide outputs 14 and 16; as well equalize the power division between the first waveguide output 14 and second waveguide output 16. The septum 50 extends the full height of the waveguide H-plane folded Y-junction. The septum 50 is placed offset from the common junction 18 end of the waveguide input by cumulative first distance 38, second distance 40, and third distance 42. The septum 50 has a septum thickness 52 equal to the standard or conventional waveguide wall thickness 54.

In the exemplary embodiment, it should be noted that the simultaneous application of the inductive first element 30, second element 32, third element 34, and septum 50 at the common junction 18 produces beneficial unexpected results (as will be demonstrated in greater detail, below). The septum 50 and elements 30, 32, and 34 work in concert to match the impedance of the structure across the entire bandwidth of the rectangular waveguide 10. The respective dimensions and relative placement of elements 30, 32, and 34, as well as the septum 50, result in very low levels of reflected power from an input signal across the entire operational frequency band of the rectangular waveguide 10; serving also to minimize amplitude and phase errors in a compact structure for a two way power combiner/divider.

As further illustrated in FIG. 2, impedance matching elements 30, 32, and 34, as well as the septum 50, include first through seventh fillets, 56, 58, 60, 62, 64, 66, 68, respectively, along corners of the waveguide walls. Fillets, 56, 58, 60, 62, 64, 66, 68 may be employed on both interior and exterior corners of impedance matching structures and at intersecting walls of the conducting body 11. Rectangular waveguides exhibit very low loss and high power capacity over other RF and microwave transmission. For high power systems, it is important to further suppress the peak electric field to avoid dielectric breakdown. The smooth corners allow for maximum power transmission through the waveguide device by softening the discontinuities in the waveguide walls; thereby minimizing associated charge buildup and standing waves which cause breakdown.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

The dimensions noted in Table 1 have been found to produce acceptable results when applied to the disclosed waveguide 10. All values noted in Table 1 are proportions, with dimensions normalized to the center frequency of the waveguide, $\lambda_{center}$.

TABLE 1

| Name | Normalized Values |
|---|---|
| a | 0.762 |

TABLE 1-continued

| Name | Normalized Values |
|---|---|
| b | 0.338667 |
| 38 | 0.010583 |
| 40 | 0.356293 |
| 42 | 0.033867 |
| 44 | 0.61193 |
| 46 | 1.566333 |
| 48 | 1.314124 |
| 52 | 0.042333 |
| 56 | 0.01905 |
| 58 | 0.02523 |
| 60 | 0.009617 |
| 62 | 0.016933 |
| 64 | 0.071967 |
| 66 | 0.005699 |
| 68 | 0.025523 |

The experimental performance of the illustrative embodiment of the waveguide 10 exhibits a minimum return loss across the waveguide 10 operational frequency band (8.2-12.4 GHz) of approximately −22 dB. That is, the return loss exceeds −20 dB over 100% of the rectangular waveguide operation frequency band. The maximum difference in the coupling to each of waveguide outputs 14 and 16 across the entire frequency band (8.2-12.4 GHz) is approximately 0.05 dB. An ideal two-way power divider would have a coupling of −3 dB to each of waveguide output 14 and 16. The worst-case coupling across the entire frequency band is approximately −3.05 dB.

Figure 3:
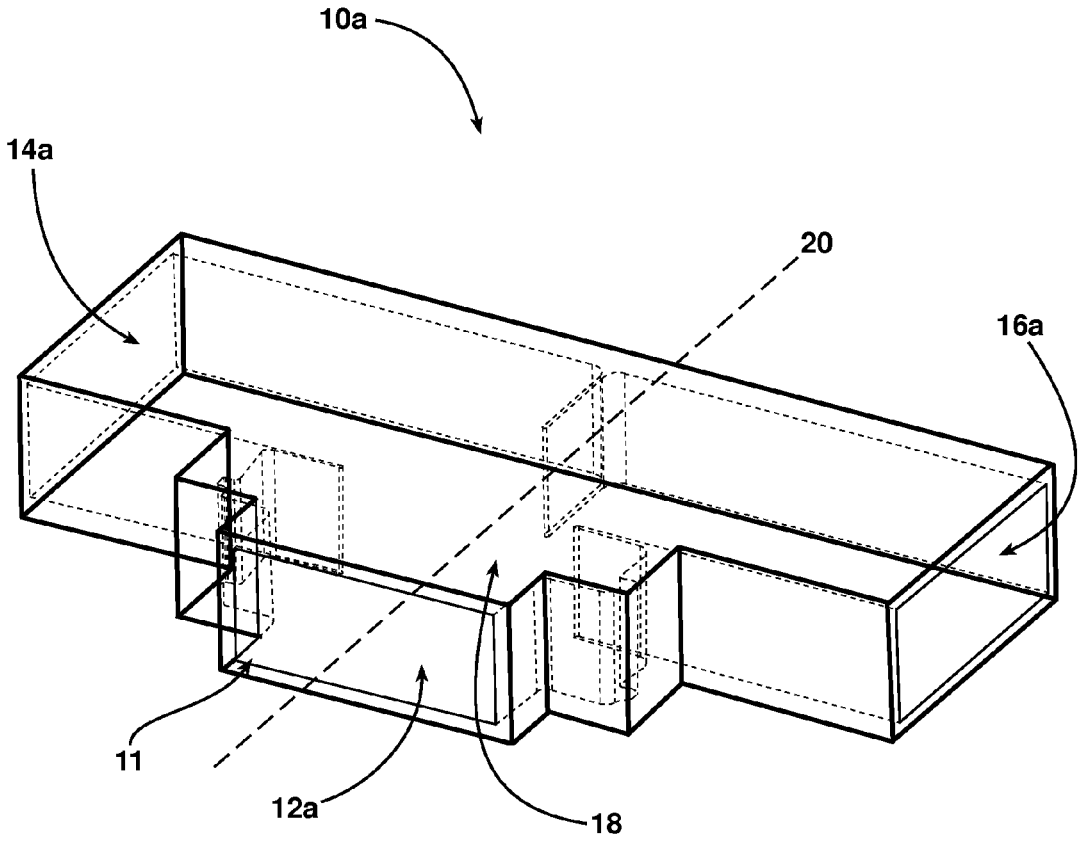
FIG. 3 is a perspective illustration of an example compact, H-plane T-junction two way (N=2) power combiner/divider in accordance with an embodiment of the disclosed invention.

Turning attention to FIG. 3., in accordance with another embodiment of the disclosed invention, a compact two way (N=2) power combiner/divider T-junction waveguide 10*a* is illustrated. The exemplary waveguide 10*a* includes a single waveguide input 12*a* and first and second waveguide outputs 14*a* and 16*a*, respectively. The input waveguide 12*a* and two output waveguides 14*a* and 16*a* are connected via a common junction 18. The two output waveguides 14*a* and 16*a* are disposed on opposite sides of the common junction 18 and perpendicular with the centerline 20 of the waveguide 10*a*. The resulting layout and geometry, as illustrated in the embodiment, is a standard H-plane T-junction power divider; where a single signal incident into waveguide input 12*a* is split equally into two signals at waveguide outputs 14*a* and 16*a*.

Figure 4:
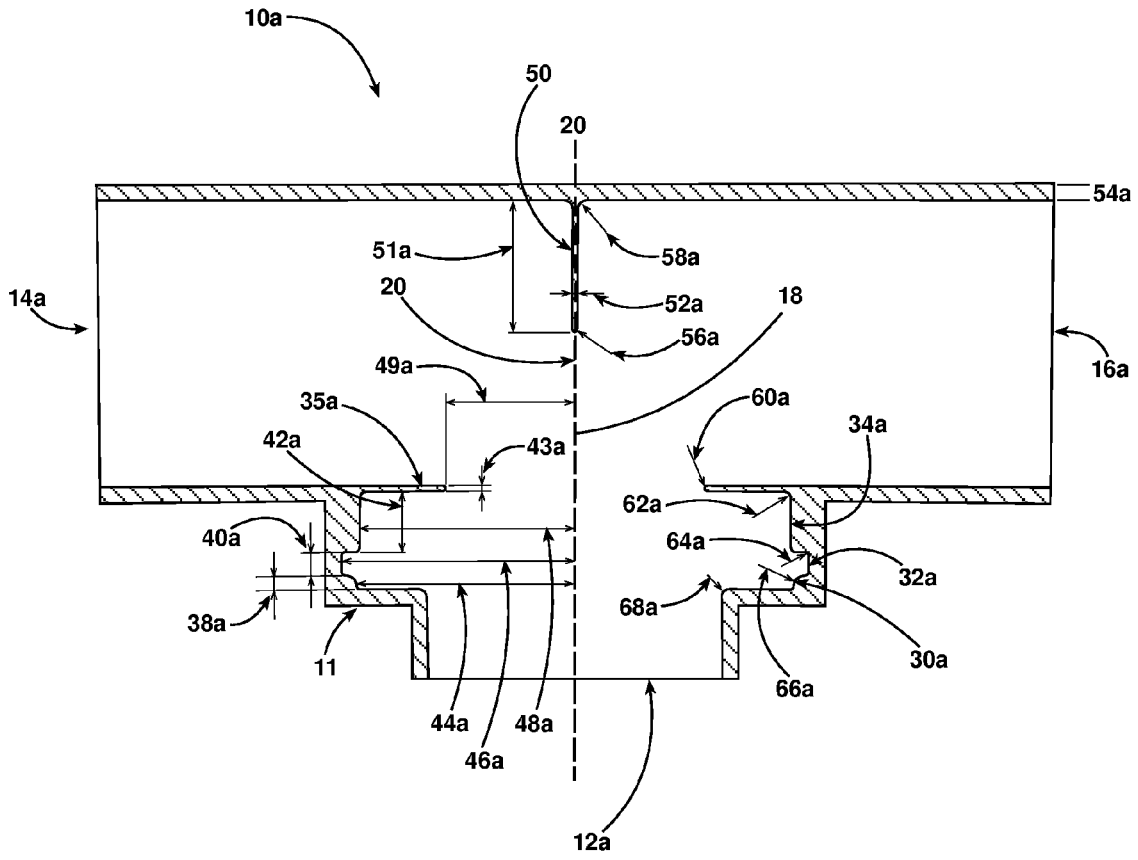
FIG. 4 is a top cutaway illustration of an example compact, H-plane T-junction two way (N=2) power combiner/divider in accordance with an embodiment of the disclosed invention.

With reference to FIG. 4, shunt inductive irises consisting of a first element 30*a*, second element 32*a*, third element 34*a*, and fourth element 35*a*, are placed symmetrically about the centerline 20. The elements 30*a*, 32*a*, 34*a*, and 35*a* are comprised of corresponding first distance 38, second distance 40*a*, third distance 42*a*, and fourth distance 43*a* and corresponding first width 44*a*, second width 46*a*, third width 48*a*, and fourth width 49*a*, respectively. The elements 30*a*, 32*a*, 34*a*, and 35*a* result in a shunt inductive reactance placed across the common junction 18 that is proportional to the opening size.

In this exemplary embodiment, the waveguide 10*a* is divided at the common junction 18 by an inductive H-plane septum 50 that serves to partially match the impedance of the common junction 18 to that of the waveguide input 12*a* and waveguide outputs 14*a* and 16*a*; as well equalize the power division between the first waveguide output 14*a* and second waveguide output 16*a*. The septum 50 extends the full height of the waveguide H-plane folded Y-junction. The septum 50 protrudes into the common junction 18 of the waveguide input 12 by a septum length 51*a* with a septum thickness 52*a* less than the standard or conventional waveguide wall thickness 54*a*

In the exemplary embodiment, it should be noted that the simultaneous application of the inductive first element 30*a*, second element 32*a*, third element 34*a*, fourth element 35*a*, and septum 50 at the common junction 18 produces beneficial unexpected results (as will be demonstrated in greater detail, below). The septum 50 and elements 30*a*, 32*a*, 34*a*, and 35*a* work in concert to match the impedance of the structure across the entire bandwidth of the rectangular waveguide 10*a*. The respective dimensions and relative placement of elements 30*a*, 32*a*, 34*a*, and 35*a*, as well as the septum 50, result in very low levels of reflected power from an input signal across the entire operational frequency band of the rectangular waveguide 10*a*; serving also to minimize amplitude and phase errors in a compact structure for a two way power combiner/divider.

As further illustrated in FIG. 4, impedance matching elements 30*a*, 32*a*, 34*a* and 35*a*, as well as the septum 50, include first through seventh fillets, 56*a*, 58*a*, 60*a*, 62*a*, 64*a*, 66*a*, 68*a*, respectively, along corners of the waveguide walls. Fillets, 56*a*, 58*a*, 60*a*, 62*a*, 64*a*, 66*a*, 68*a* may be employed on both interior and exterior corners of impedance matching structures and at intersecting walls of the conducting body 11. Generally, rectangular waveguides exhibit very low loss and high power capacity over other RF and microwave transmission. For high power systems, it is important to further suppress the peak electric field to avoid dielectric breakdown. The smooth corners allow for maximum power transmission through the waveguide device by softening the discontinuities in the waveguide walls; thereby minimizing associated charge buildup and standing waves which cause breakdown.

The dimensions noted in Table 2 have been found to produce acceptable results when applied to the disclosed waveguide 10*a*. All values noted in Table 2 are proportions, with dimensions normalized to the center frequency of the waveguide, $\lambda_{center}$.

TABLE 2

| Name | Normalized Values |
|---|---|
| b | 0.338666667 |
| a | 0.762 |
| 38a | 0.042983388 |
| 40a | 0.057819449 |
| 42a | 0.166524168 |
| 43a | 0.008966959 |
| 44a | 1.163467619 |
| 46a | 1.229195056 |
| 48a | 1.130172981 |
| 49a | 0.677769406 |
| 51a | 0.340314372 |
| 52a | 0.008466667 |
| 56a | 0.001671131 |
| 58a | 0.042333333 |
| 60a | 0.002780448 |
| 62a | 0.018684269 |
| 64a | 0.008466667 |
| 66a | 0.0254 |
| 68a | 0.030939035 |

The experimental performance of the illustrative embodiment of the waveguide 10*a* exhibits a minimum return loss across the waveguide 10*a* operational frequency band (8.2-12.4 GHz) of approximately −25 dB. That is, the return loss exceeds −20 dB over 100% of the rectangular waveguide 10*a* operation frequency band. The maximum difference in the coupling to the first waveguide output 14*a* and second waveguide output 16*a* across the entire frequency band (8.2-12.4 GHz) is approximately 0.04 dB. An ideal two-way power divider would have a coupling of −3 dB to each of output waveguides 14*a* and 16*a*. In the example embodiment, the worst-case coupling across the entire frequency band is approximately −3.04 dB.

Figure 5:
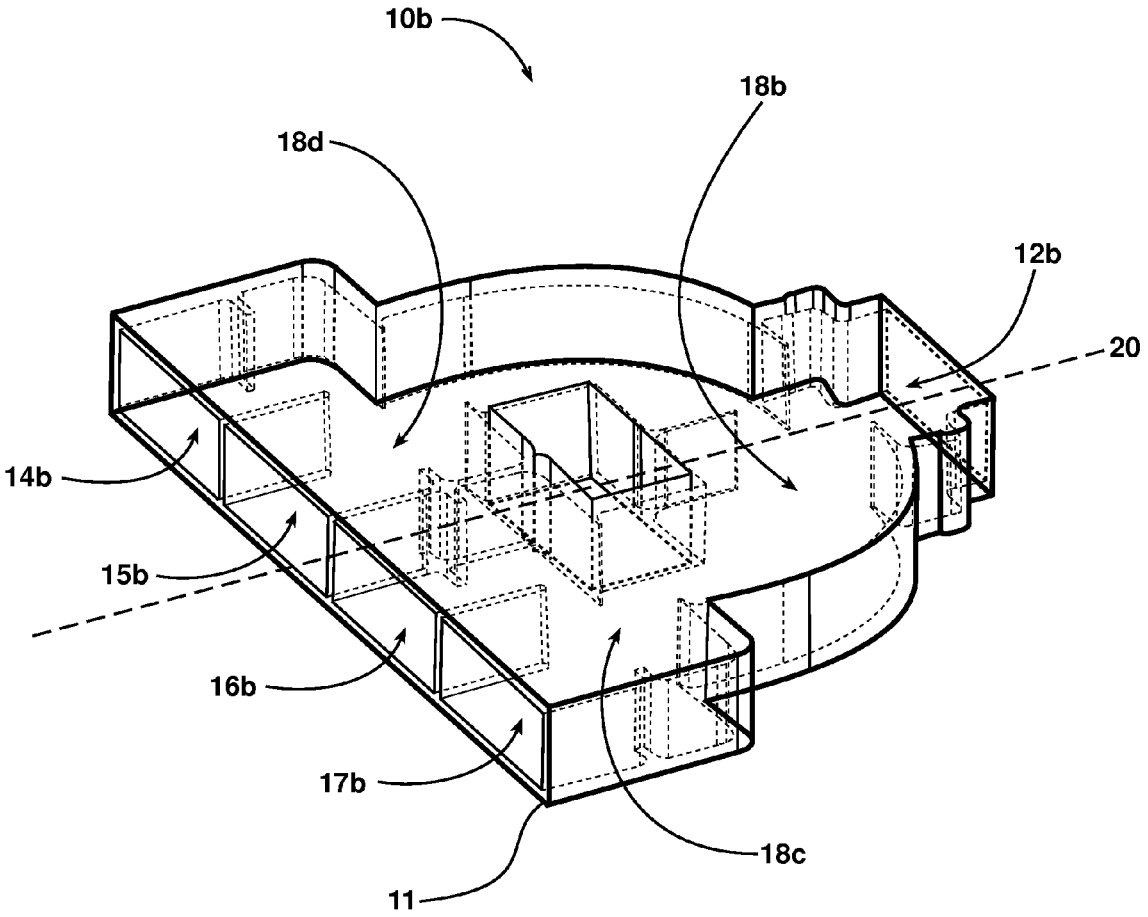
FIG. 5 is a perspective illustration of an example compact four way (N=4) power combiner/divider in accordance with an embodiment of the disclosed invention.

With reference to FIG. 5, in an example embodiment, a compact four way (N=4) power combiner/divider is realized in a combination waveguide 10*b* folded Y- and T-junction structure. The example waveguide 10*b* comprises a single waveguide input 12*b* and first through fourth waveguide outputs 14*b*-17*b*, respectively. The waveguide input 12*b*, and waveguide outputs 14*b*-17*b*, may be referred to as "waveguide portions" of the larger waveguide 10*b*. Additionally, the outer shell of the waveguide 10*b* may be described as having a conductive body 11. The single waveguide input 12*b* and four output waveguides 14*b*-17*b* are connected via first through third common junctions 18*b*-18*d*, respectively. The common junctions 18*c* and 18*d* include the impedance matching features specified in FIG. 1-2. The resulting layout and geometry, as illustrated in the embodiment of FIG. 5, is a compact H-plane 1:4 power divider; where a single signal incident into waveguide input 12*b* is split equally into four signals at waveguide outputs 14*b*-17*b*.

Figure 6:
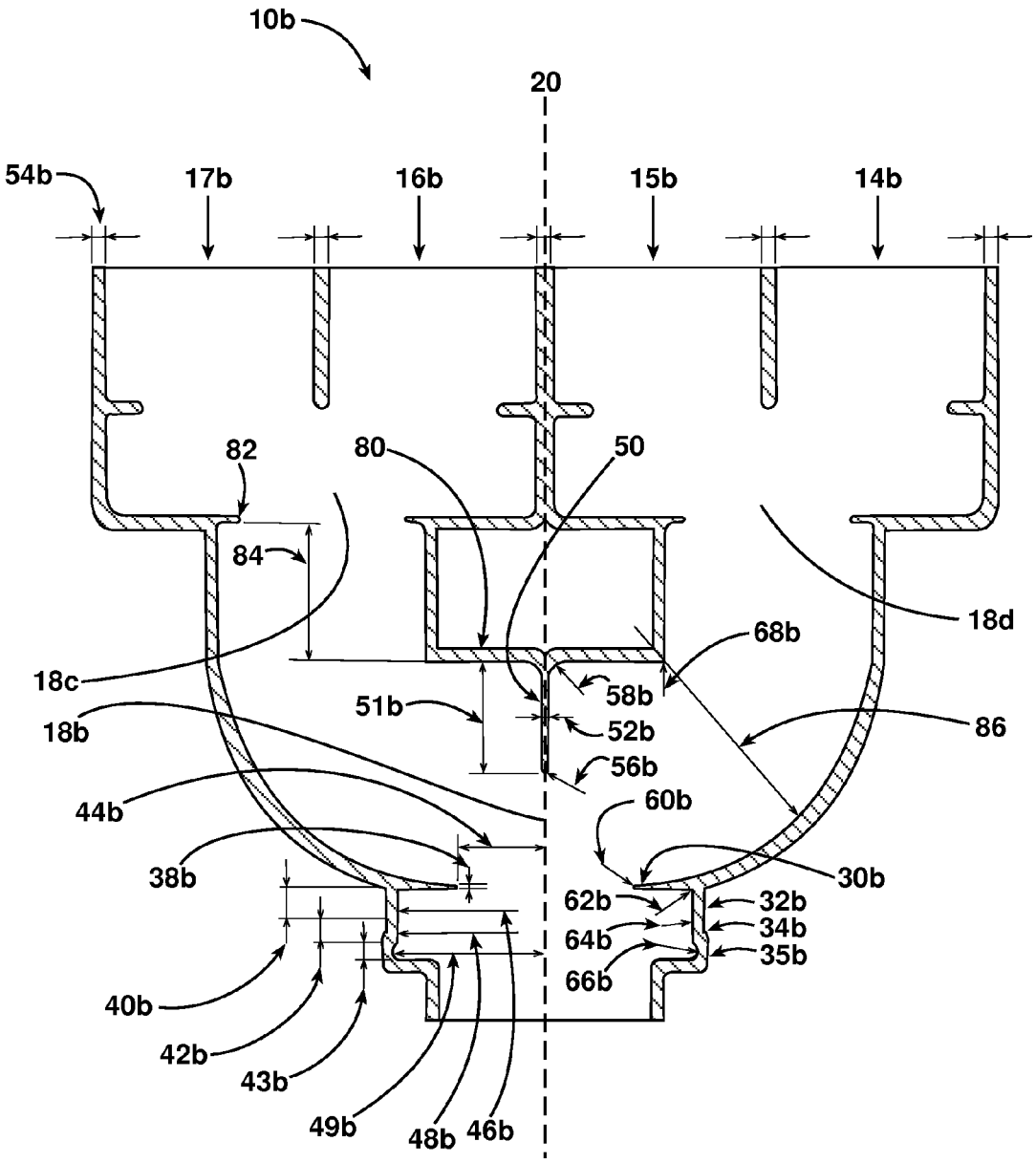
FIG. 6 is a top cutaway illustration of an example compact four way (N=4) power combiner/divider in accordance with an embodiment of the disclosed invention.

With reference to FIG. 6, the waveguide 10*b* T-junction wall 80 is offset from the folded Y-junction iris element 82 by length 84. The waveguide 10*b* arms connecting the H-plane first common junction 18*b* and folded Y third common junction 18*d* include a substantial fillet 86 beginning at the inductive iris first element 30*b* and extending to the onset of the folded Y third common junction 18*d*. A similar structure is reflected about the centerline 20. Shunt inductive irises consisting of first through fourth elements 30*b*, 32*b*, 34*b*, and 35*b* are place symmetrically about the centerline 20. The elements 30*b*, 32*b*, 34*b*, and 35*b* are comprised of corresponding first distance 38*b*, second distance 40*b*, third distance 42*b*, and fourth distance 43*b* and corresponding first width 44*b*, second width 46*b*, third width 48*b*, and fourth width 49*b*, respectively. The elements 30*b*, 32*b*, 34*b*, and 35*b* result in a shunt inductive reactance placed across the waveguide 10*b* common junction 18*b*.

In the example embodiment, the waveguide 10*b* is divided at the first common junction 18*b* by an inductive H-plane septum 50 that serves to partially match the impedance of the first common junction 18*b* to that of the waveguide input 12*b* and output waveguides 14*b*-17*b*; as well equalize the power division between the four waveguide outputs 14*b*-17*b*. The septum 50 extends the full height of the waveguide H-plane T-junction. The septum 50 protrudes into the first common junction 18*b* of the input waveguide by septum length 51*b* with a septum thickness 52*b* less than the standard or conventional waveguide wall thickness 54*b*.

In the exemplary embodiment, it should be noted that the simultaneous application of the inductive first element 30*b*, second element 32*b*, third element 34*b*, fourth element 35*b*, and septum 50 at the first common junction 18*b* produce beneficial unexpected results. The septum 50 and elements 30*b*, 32*b*, 34*b*, and 35*b* work in concert to match the impedance of the structure across the entire bandwidth of the rectangular waveguide 10. The respective dimensions and relative placement of elements 30*b*, 32*b*, 34*b*, and 35*b*, as well as the septum 50, result in very low levels of reflected power from an input signal across the entire operational frequency band of the rectangular waveguide 10*b*; serving also to minimize amplitude and phase errors in a compact structure for a 4 way power combiner/divider.

As illustrated in FIG. 6, impedance matching features 30*b*, 32*b*, 34*b*, and 35*b* include first through seventh fillets 56*b*, 58*b*, 60*b*, 62*b*, 64*b*, 56*b*, and 58*b* along corners of impedance matching structures and along intersecting walls of the conductive body 11. Rectangular waveguides exhibit very low loss and high power capacity over other RF and microwave transmission. For high power systems, it is important to further suppress the peak electric field to avoid dielectric breakdown. The smooth corners allow for maximum power transmission through the waveguide 10*b* device by softening the discontinuities in the waveguide 10*b* walls; thereby minimizing associated charge buildup and standing waves which cause breakdown.

The dimensions noted in Table 3 have been found to produce acceptable results when applied to the disclosed waveguide 10*b*. All values noted in Table 3 are proportions, with dimensions normalized to the center frequency of the waveguide, $\lambda_{center}$.

TABLE 3

| Name | Normalized Values |
|---|---|
| b | 0.338666667 |
| a | 0.762 |
| 38b | 0.010822063 |
| 40b | 0.117119906 |
| 42b | 0.078404096 |
| 43b | 0.051318922 |
| 44b | 0.646261897 |
| 46b | 1.064025644 |
| 48b | 1.059366616 |
| 49b | 1.086216117 |
| 51b | 0.373444747 |
| 52b | 0.008466667 |
| 54b | 0.042333333 |
| 56b | 0.001671131 |
| 58b | 0.067359803 |
| 60b | 0.002780448 |
| 62b | 0.018684269 |
| 64b | 0.008466667 |
| 66b | 0.0254 |
| 68b | 0.005974251 |
| 84 | 0.474142848 |
| 86 | 0.858521639 |

The experimental performance of the illustrative embodiment of the waveguide 10*b* exhibits a minimum return loss across the waveguide operational frequency band (8.2-12.4 GHz) of approximately −22 dB. That is, the return loss exceeds −20 dB over 100% of the rectangular waveguide operation frequency band. The maximum difference in the coupling to different output waveguides across the entire frequency band (8.2-12.4 GHz) is approximately 0.05 dB. An ideal two-way power divider would have a coupling of −3 dB to each output waveguide. In the example embodiment, the worst-case coupling across the entire frequency band is approximately −3.05 dB.

Each of the embodiments described above may be used in an antenna array, such as antenna arrays for X band monopulse radar or Ku and Ka band satellite communications applications. It is noted that a combination of two-way folded-Y junction waveguide power can be used to form higher order (N=8, 16, 32 . . . ) power combiner/divider structures. Moreover, the antenna array can be configured to be mechanically pointed, rotating about one or more axis of rotation. Thus, the antenna array can be a non-electrically scanning array for aerospace applications.

In summary, a compact waveguide power divider is comprised of an input waveguide that terminates at a common junction with two output waveguides, on opposite sides of the junction and collinear with the centerline of input waveguide. A combination of symmetrical irises with a bifurcating inductive septum serves to impedance match the structure across the entire operational frequency band of the rectangular waveguide. The embodiment may operate in either a power combiner or divider mode of operation. As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A high bandwidth, low signal error, compact waveguide comprising:

a conductive body including a waveguide input portion and a plurality of waveguide output portions disposed coplanar with the input waveguide portion;

a common junction joining the input waveguide portion and the plurality of output waveguide portions;

a septum disposed proximate the common junction collinear with a centerline of the input waveguide portion; and a plurality of iris elements disposed proximate the common junction transverse to the centerline of the input waveguide portion;

wherein the septum and the plurality of iris elements changes an impedance of the common junction to match the impedance across the entire waveguide bandwidth.

2. The waveguide of claim 1, wherein a corner of the septum or the iris element includes a fillet.

3. The waveguide of claim 1, wherein a corner of the conductive body includes a fillet.

4. The waveguide of claim 1, wherein one of the plurality of output waveguide portions is adjacent another of the plurality of output waveguide portions.

5. The waveguide of claim 1, wherein one of the plurality of output waveguide portions is opposite another of the plurality of output waveguide portions.

6. The waveguide of claim 1, wherein the plurality of iris elements consists of at least two iris elements.

7. The waveguide of claim 1, further including a T-junction wall perpendicular to the septum and offset by a length from a T-junction iris element, and a substantial fillet forming a portion of the conductive body disposed between the input waveguide portion and one of the plurality of waveguide output portions.

8. The waveguide of claim 7, wherein the plurality of waveguide output portions consists of 4 output portions.

9. A high bandwidth, low signal error, compact waveguide comprising:

a conductive body and shunt junction, wherein the conductive body includes a waveguide input portion and a plurality of waveguide output portions disposed coplanar with the input waveguide portion;

a common junction joining the input waveguide portion and the plurality of output waveguide portions;

a septum disposed proximate the common junction collinear with a centerline of the input waveguide portion; and a plurality of inductive iris elements disposed proximate the common junction transverse to the centerline of the input waveguide portion;

wherein the septum and the plurality of iris elements changes an impedance of the common junction to match the impedance across the entire waveguide bandwidth; and wherein a distance between a pair of iris elements is greater than a width of the input waveguide portion.

10. A high bandwidth, low signal error, compact waveguide comprising:

a conductive body including a waveguide input portion and a plurality of waveguide output portions disposed coplanar with the input waveguide portion;

a common junction joining the input waveguide portion and the plurality of output waveguide portions;

a septum disposed proximate the common junction collinear with a centerline of the input waveguide portion; and a plurality of iris elements disposed proximate the common junction transverse to the centerline of the input waveguide portion;

wherein the septum and the plurality of iris elements changes an impedance of the common junction to match the impedance across the entire waveguide bandwidth; and a T-junction wall perpendicular to the septum and offset by a length from a T-junction iris element, and a substantial fillet forming a portion of the conductive body disposed between the input waveguide portion and one of the plurality of waveguide output portions.

11. The apparatus of claim 10, wherein the plurality of waveguide output portions consists of 4 output portions.

* * * * *